US007247016B2

(12) United States Patent
Mashhour

(10) Patent No.: US 7,247,016 B2
(45) Date of Patent: Jul. 24, 2007

(54) FLARE STACK COMBUSTION APPARATUS AND METHOD

(75) Inventor: Mazen M. Mashhour, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/475,285

(22) PCT Filed: Apr. 18, 2002

(86) PCT No.: PCT/US02/12443

§ 371 (c)(1),
(2), (4) Date: May 28, 2004

(87) PCT Pub. No.: WO02/086386

PCT Pub. Date: Oct. 31, 2002

(65) Prior Publication Data

US 2004/0248055 A1 Dec. 9, 2004

(51) Int. Cl.
*F23D 14/46* (2006.01)
*F23G 7/08* (2006.01)
*F23J 15/00* (2006.01)

(52) U.S. Cl. ..... 431/202; 431/5; 422/168

(58) Field of Classification Search ..... 431/202, 431/5, 182, 185, 355, 285; 110/344, 345, 110/346; 422/168
See application file for complete search history.

(56) References Cited

U.S. PATENT DOCUMENTS 3,512,911 A 5/1970 Reed et al. ..... 431/202
3,554,681 A 1/1971 Proctor ..... 431/202
3,864,072 A 2/1975 Abernathy et al. ..... 431/5
3,914,093 A 10/1975 Proctor ..... 431/202
3,924,658 A 12/1975 Lazarre et al. ..... 431/202
4,003,693 A 1/1977 Straitz ..... 431/202
4,019,852 A 4/1977 Hemmer et al. ..... 431/5
4,036,580 A 7/1977 Reed et al. ..... 431/202

(Continued)

FOREIGN PATENT DOCUMENTS

GB 2081 872 A * 2/1982

(Continued)

OTHER PUBLICATIONS

International Search Report Sep. 5, 2002.

(Continued)

*Primary Examiner*—Josiah C. Cocks
(74) *Attorney, Agent, or Firm*—Abelman, Frayne & Schwab

(57) ABSTRACT

High-pressure air is discharged in the form of jets moving at a high velocity from nozzles (32) mounted on a ring manifold (30) that encircles the flare stack (10) at a predetermined distance below the flare tip (12), the upper portion of the flare stack being surrounded by an exterior shield (50) that is provided with internal guide vanes (36) at the top portion and perforated with air passages (52) at the bottom portion. The high-velocity air movement in the annular space creates a low pressure zone that in turn induces a larger volume of air from the atmosphere to enter the annular space between the shield and stack where it rises to the flame zone (58), thereby lifting the flame and enhancing turbulent air, fuel and waste gas mixing in the flame zone to minimize or eliminate smoke.

21 Claims, 4 Drawing Sheets

U.S. PATENT DOCUMENTS

| | | | | |
|---|---|---|---|---|
| 4,052,142 | A | 10/1977 | Reed et al. | |
| 4,098,566 | A | 7/1978 | Zink et al. | 431/202 |
| 4,323,343 | A | 4/1982 | Reed et al. | 431/202 |
| 4,643,669 | A * | 2/1987 | Bozai | 431/202 |
| 4,652,232 | A | 3/1987 | Schwartz et al. | 431/202 |
| 5,380,195 | A | 1/1995 | Reid et al. | 431/202 |
| 5,735,683 | A | 4/1998 | Muschelknautz | 431/202 |
| 5,749,719 | A | 5/1998 | Rajewski | 431/202 |
| 5,788,477 | A | 8/1998 | Jones | 431/202 |
| 5,813,849 | A | 9/1998 | Schwartz et al. | 431/202 |
| 5,865,613 | A | 2/1999 | Rajewski | 431/202 |
| 6,168,422 | B1 | 1/2001 | Motyka et al. | 431/202 |

FOREIGN PATENT DOCUMENTS

| | | |
|---|---|---|
| JP | 59-97330 | 12/1982 |
| JP | 59-219616 | 5/1983 |
| JP | 10-311522 | 5/1997 |

OTHER PUBLICATIONS

JP Office Communication—Notification of Reasons for Refusal (Dispatch No. 266771); Jun. 27, 2006.

* cited by examiner

FLARE STACK COMBUSTION APPARATUS AND METHOD

FIELD OF INVENTION

This invention relates to the construction and operation of flaring stacks utilized to burn undesired by-product streams for release into the atmosphere.

BACKGROUND OF THE INVENTION

The flaring or assisted open combustion of undesired process by-product streams is commonly used to oxidize and convert toxic gases and vapors to their less harmful combustion products for release into the environment. A mixture of the undesired product and a fuel are directed to the base of the flare stack to form a feedstream that rises to the flare tip or stack outlet where the mixture is ignited in the combustion zone to form the flare or flame. The efficient and complete combustion of the mixture is not always achieved. When the process is not properly managed, smoke is also produced by this process. Smoke can be an indicator that the combustion process is incomplete, and that the toxic or otherwise undesired process materials have not been converted to less harmful forms. Smoke is also a visible constituent of air pollution, and its elimination or reduction is a consistent operational goal.

In order to reduce smoke production, the installation of air and steam systems in conjunction with flaring stacks has been undertaken by the prior art. The low-pressure air assist system uses forced air to provide the air and fuel mixing required for smokeless operation. A fan, commonly installed in the bottom of the flare stack, provides the combustion air required. Steam assisted flare systems use a steam ring and nozzles to inject steam into the combustion zone at the flare tip where air, steam and fuel gas are mixed together to produce a smokeless flame. In some systems of the prior art, a concentric banner or shield is provided that surrounds the flare tip or outlet.

Steam and low-pressure air assists for flaring are in common use because both systems are considered by the art to be generally effective and relatively economical as compared to alternative means for disposing of the undesired by-products.

However, both of these prior art systems have various drawbacks and deficiencies. The low-pressure air assists requires a significant capital expenditure for at least one fan that must be dedicated to the flare stack. Continuous operation imposed a rigorous maintenance schedule and even a back-up system in case of a breakdown or major repairs.

Steam assist systems can require sophisticated control devices, have relatively high utility requirements and maintenance/replacement schedules.

Various methods and configurations of apparatus have been proposed in the disclosures of the patent literature to improve the efficiency of combustion of flare stacks. For example, U.S. Pat. No. 5,788,477 discloses a ring manifold fitted with an array of nozzles that can be directed inwardly, upwardly and at an angle that is displaced laterally to inject high pressure air jets above the outlet of the fuel gas at the tip of the stack. Similarly, in U.S. Pat. No. 4,652,232, a plurality of nozzles are mounted on a high pressure fluid manifold that encircles the stack and emits the fluid at or somewhat above the level of the rim of the waste gas stack, and the nozzles are angled upwardly.

Other constructions are disclosed and discussed in U.S. Pat. No. 4,019,852 as the background in the art.

In the constructions of the first two prior art patents, the nozzles or manifolds containing the high pressure fluid outlets are in close proximity to the flame, if not engulfed by the flame under foreseeable atmospheric conditions cross-winds. The maintenance and replacement costs associated with these arrangements can be significant.

It is therefore a principal object of the present invention to provide an apparatus and method for enhancing the complete combustion of flare gases that is less expensive to install, requires minimal maintenance, and is adaptable to the varying operating conditions found in industrial plant operations.

Another object of the invention is to provide a method and apparatus that is readily adapted for use with existing flare stacks without significantly modifying the existing stack tip or outlet configurations.

SUMMARY OF THE INVENTION

The above objects and other advantages are realized by the method and apparatus of the invention that utilizes high-velocity jets or streams of air in an annular space defined by the stack and a concentric shield and that are moving in the direction of the flame to create a zone of rapidly moving air that is at a lower pressure than that of the surrounding atmospheric air mass. This low-pressure zone draws atmospheric air into the annular space and creates a larger mass of air moving in the direction of the combustion zone. This larger mass of air is directed into the flame combustion zone to assist the flare achieve complete combustion of the feedstream.

The principal novel aspect of this invention is the use of air jets that induce large volumes of air from the environment to flow upwardly from a low pressure zone. The apparatus used consists of one or more distribution ring manifolds and associated nozzles that are positioned a predetermined distance below the rim or tip of the stack, the nozzle outlets aimed to direct the high pressure air jets upwardly toward the tip and the flame. The preferred high pressure operating range is from about 30 to 60 psig, and more preferably, from about 30 to 35 psig.

The distance below the rim that the nozzles are positioned can be determined empirically or by applying known methods and mathematical models and equations. The position will optimize the zone of low pressure to maximize the influx or flow of atmospheric air into the annular space defined by the stack and its shield to create a zone of turbulent mixing of air, fuel and waste gas at, and in the vicinity of the flame.

The nozzles can also advantageously be angled from the vertical axis and in a direction that is also generally tangential to the adjacent flare stack surface. The effect of this nozzle positioning will be to at least initially creating a swirling or helically rising series of air jets in the annular space between the shield and stack.

To further promote this helical movement, a plurality of vanes are mounted in the annular space, preferably attached to the shield's inner surface. The vanes are preferably curvilinear and extend from at least the to the region proximate the end of the stack to the vicinity of the high pressure nozzles. The effect of the vanes on the rising expanding air mass is to create and/or maintain turbulent flow patterns that will enhance the complete combustion of the waste and fuel gasses in the flame.

In a further preferred embodiment, a plurality of low pressure air streams are directed generally upwardly and inwardly from nozzles positioned around the periphery of the rim or open end of the stack. The preferred operating range for the low pressure nozzles if from about 5 to 10 psig.

The apparatus and method can be advantageously utilized with existing or newly constructed flare stacks fitted with shields having an upper rim that terminates at the same elevation as the tip or rim of the stack, or those shields that extend above the stack, and are either straight-sided or tapered.

The method of the invention provides an economical solution for the smokeless flaring of undesired gases from production and processing facilities. The high-pressure air is provided by piping that extends up the exterior of the flare stack to a high-pressure air distribution ring manifold and jets surrounded by a shield. A zone of turbulence is created that is needed for smokeless operation.

The specific configuration of the apparatus used in the practice of the invention varies according to the flare gas rate and the geometry of the flare tip or outlet. The invention makes economical the use of high-pressure air. The volume of compressed air required is relatively small compared to the requirements for either low-pressure air or the steam used in the systems of the prior art. Moreover, the piping and nozzles are not subjected to the adverse effects of steam.

BRIEF DESCRIPTION OF THE DRAWINGS

The apparatus and method of the invention will be described below and in reference to the appended drawings wherein like elements are referred to by the same numerals and in which.

DETAILED DESCRIPTION OF THE INVENTION

Figure 1:
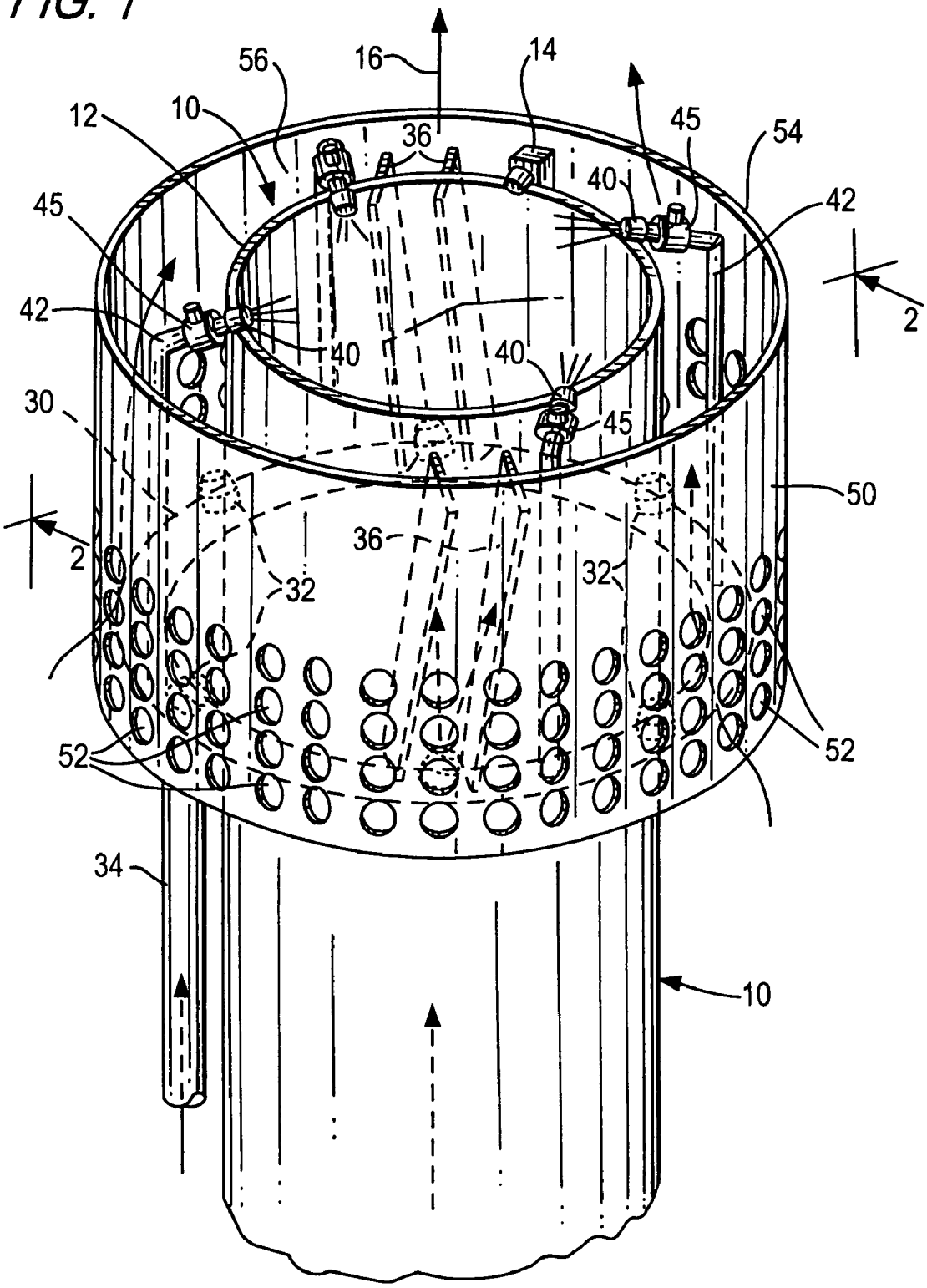
FIG. 1 is a top perspective view, partly in section, showing one preferred embodiment of the invention.

The invention will be further described with reference to FIG. 1, in which there is schematically illustrated the upper portion of a flare stack (10) terminating in outlet or tip (12) that is open to the atmosphere. The stack is provided with one or more igniters (14) which are utilized in the conventional manner to ignite the combustible feedstream as it exits stack outlet (12). In this embodiment, a concentric barrier or shield (50) is positioned about the upper end portion of the stack, with its upper end (54) at the same elevation as the stack outlet (12). The shield (50) is of a generally cylindrical configuration and can be supported by a plurality of brackets (55) that are attached to the outer wall of stack (10). The composition of the combustible feedstream (16) and the specific configuration of the stack (10), outlet (12) and igniters can be of any configuration known to the prior art, or any new design developed in the future.

In the practice of the embodiment of the invention illustrated in FIG. 1, a high-pressure manifold (30) encircles the exterior of the stack and is provided with a plurality of high-pressure nozzles (32) or other outlets, each of which produce a jet of air that is directed upwardly in the direction of the stack outlet and flame. The manifold (30) is fed by high-pressure air conduit (34) that is in fluid communication with a steady source of high-pressure air. In a preferred embodiment, the air is delivered to the nozzles at a pressure of about 30 to 35 psig.

The high-pressure nozzles are positioned on the manifold (30) at predetermined intervals based upon the geometry of the flare stack, flare tip and the composition of the combustible feedstream and its pressure.

As will be understood from FIGS. 1 and 2, the discharge of the pressurized air streams from nozzles (32) at a high-velocity creates a low-pressure zone below the nozzles as the air moves upwardly. Air is drawn into the annular region (56) between the stack (10) and shield (50). This induced air flow provides a large volume of air that rises towards the flame and eventually mixes with the hot gases to enhance the complete combustion of the fuel gas and undesired chemical(s) in the feedstream. The mixing is turbulent, which further enhances the complete combustion of the feedstream.

In order to assure a sufficient volume of atmospheric air flow from the area around and below the high-pressure nozzles (32), the external shield (50) is preferably provided with a plurality of spaced air passages (52) about its lower perimeter. The size, number and spacing of the air passages is determined with respect to the air flow requirements of a particular installation. If the manifold is of a size and configuration that impedes the flow of air into and through the annular space between the stack and shield, then additional air passages in shield (52) are provided to assure a sufficient volume of air flow to constitute the volume required to enhance turbulence and complete combustion at the flame zone (58).

It is desirable to optimize the atmospheric air flow into the annular space based on the configuration of the installation with which the invention is used. The volume of the annular space should not be so great as to reduce the flow rate of the air mass and its turbulence.

As will also be apparent to one of ordinary skill in the art, during the flaring the shield (52) is heated as a result of its proximity to the flame. One effect of the heating of the shield is to cause atmospheric air coming into contact with the surface of the shield to be heated and therefore expand and naturally rise. Even without the presence of the pressurized high-velocity air injected by the arrangement of the present invention, a natural vertical convection, or chimney effect, is created in the annular space between stack (10) and shield (50). In accordance with the present invention, this effect is enhanced and magnified by the large volume of atmospheric air that is induced to enter the low-pressure zone in the annular space from below and around the air jets. The increased volume of rising air is heated, causing further expansion and turbulence to enhance combustion in the flame zone.

The shield (50) around the tip also serves to increase the turbulence in the combustion zone due to the high temperature difference between the metal and the air. The low-pressure transfer in the reaction or combustion zone promotes a smokeless reaction, and also controls the wind around the flame. The amount of compressed air used in the practice of the invention is very small compared to the air induced from the atmosphere. The ratio of compressed air volume to atmospheric air drawn into the annular space can be up to 1:300, depending on the configuration of the ring and nozzles.

Figure 2:
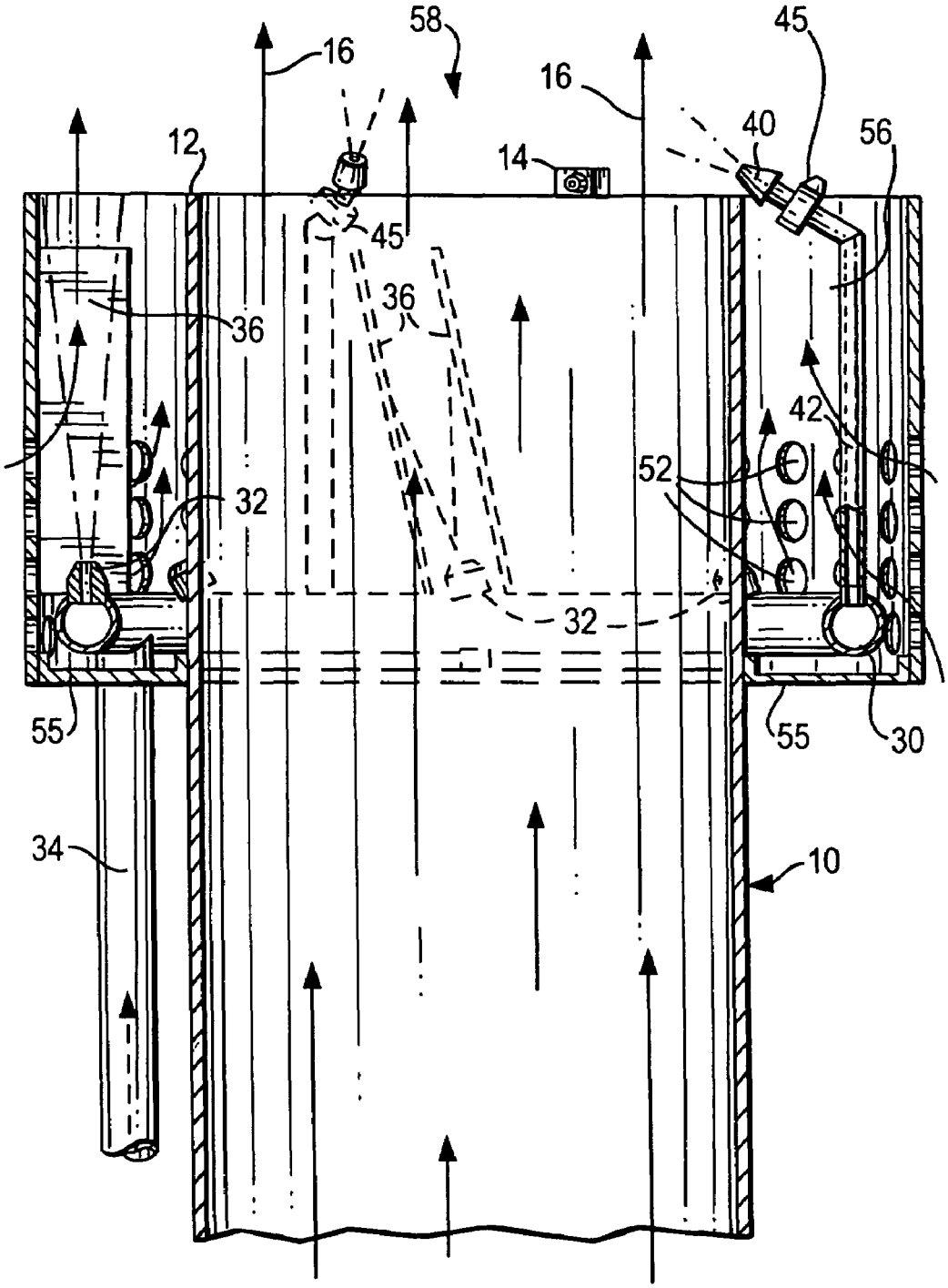
FIG. 2 is a cross-sectional view of FIG. 1, taken along section line 2-2.
Figure 3:
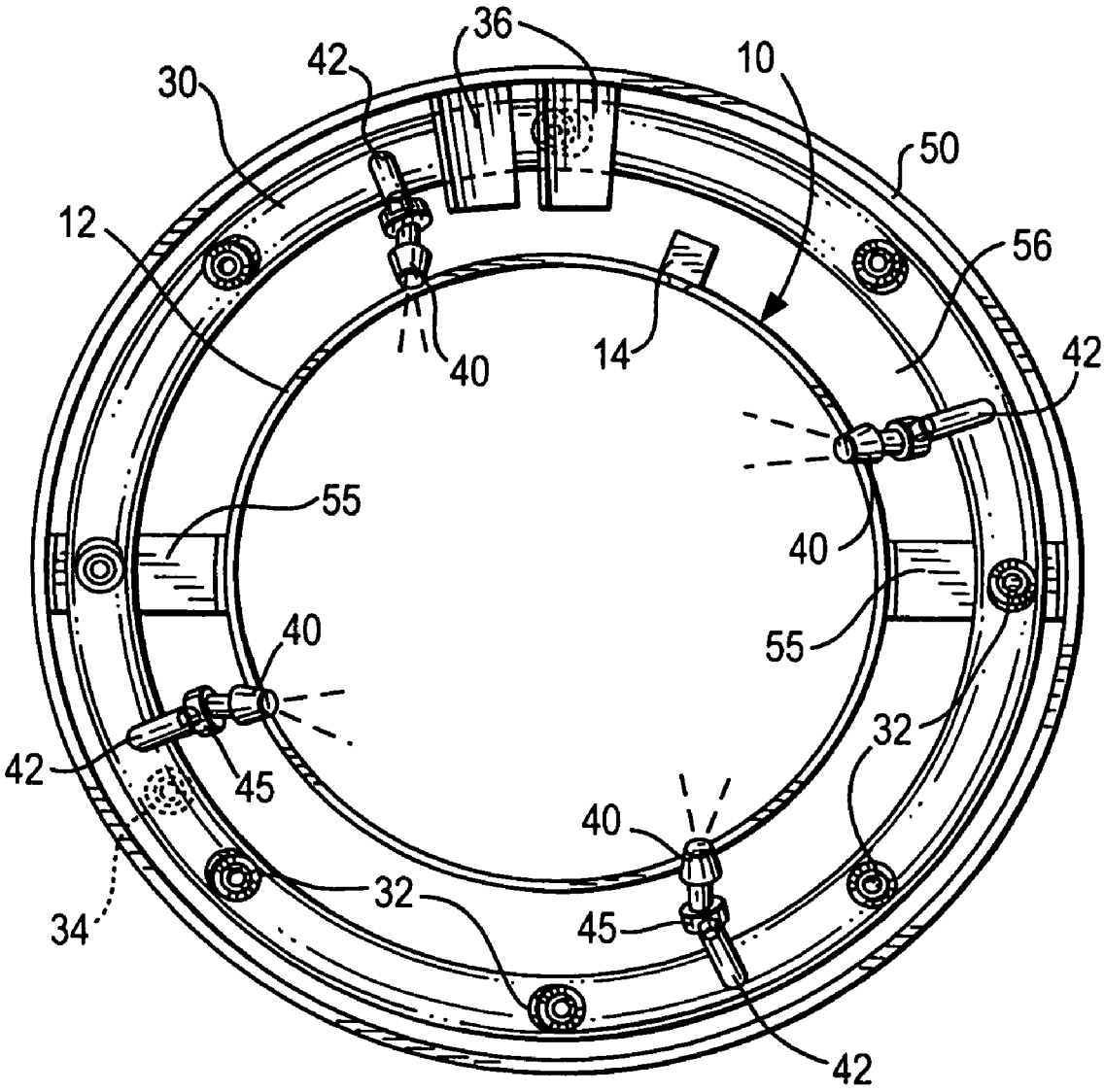
FIG. 3 is a top plan view of the embodiment of FIG. 1.

With continuing reference to FIGS. 1 and 2, a plurality of spaced vanes or baffles (36) are optionally provided to direct the air flow in the annular space between the stack (10) and shield (50). In the interest of clarity, the number of vanes illustrated is limited in FIGS. 1-3. The vanes can serve to provide a more uniform air distribution at the center of the flame by moving the expanding air mass in a directed path through the annular space 56 into which the vanes project. In a preferred embodiment of the invention, vanes are attached to the shield flanking each of the high-pressure nozzles and are inclined from the vertical at any angle comparable to the angle of the air jet emanating from the adjacent nozzle. Thus, in the embodiment illustrated, a total of sixteen vanes will be provided, two associated with each of the eight high-pressure air discharge nozzles. The vanes can be of a spiral configuration to direct the rising air mass toward the stack rim.

In a further preferred embodiment, a plurality of low-pressure wind control nozzles (40), fed by low pressure conduits (42), are spaced about the periphery of the stack outlet (12). Nozzles (40) are supplied by a source of low-pressure air at about 5 to 10 psig.

As shown in FIG. 1, the nozzles (40) are in fluid communication with the pressure reducing device (45) downstream on conduit (42). Alternatively, a separate low pressure manifold system (not shown) can be provided. Other alternative arrangements for the either/or both the high and low pressurized air feed and distribution systems will be apparent to those of ordinary skill in the art.

The wind control nozzles function to minimize the effect of atmospheric cross winds that can disrupt the optimum combustion pattern of the flame; and to push the carbon dioxide combustion product away from the flame to prevent further undesired reactions. In a preferred embodiment, nozzles (40) have a diameter of about 0.0625 m/2 mm and are positioned at 90° intervals about the top of the stack. The low pressure nozzles (40) are directed at a 45° angle to the diameter line across the stack opening.

In the preferred embodiment described above, manifold (30) is fitted with a plurality of high-pressure nozzles (32). In an alternative embodiment, the tubular manifold (30) can be machined or otherwise provided with a plurality of directionally oriented outlets for the discharge of the high-pressure air in place of nozzles (32). These outlets preferably are at an angle of about 45° and emit the jets of high pressure air in a direction that is tangential to the adjacent stack surface, i.e., the horizontal vector of the air jet is normal to a diameter passing through the outlet.

Figure 4:
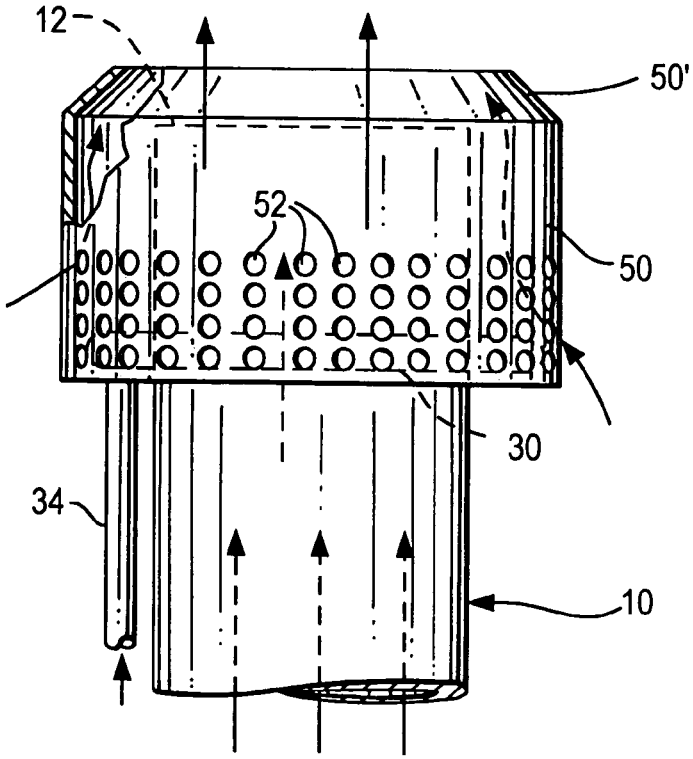
FIG. 4 is a schematic side view, partially broken away, of another embodiment of the invention used with a flare tip of a different design.
Figure 5:
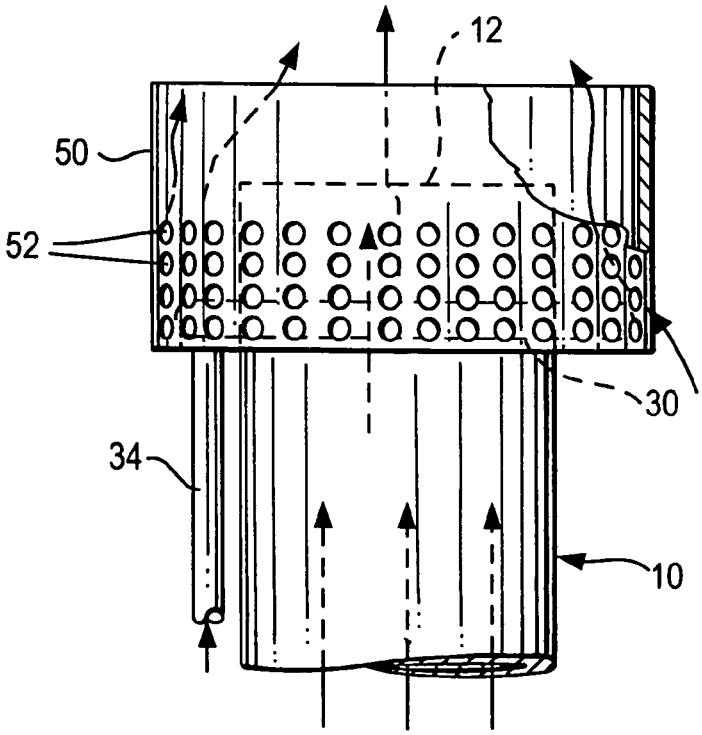
FIG. 5 is a schematic side view, partially broken away, of a further embodiment of the invention used with a flare tip of yet a different design.

Two further embodiments of the invention are illustrated in FIGS. 4 and 5, wherein the same arrangements of high-pressure nozzles are employed. In FIG. 4, the shield (50) has an upper end (50') that is inwardly tapered, and terminates above the end of the stack (10). In FIG. 5, the shield (50) is cylindrical and also terminates above the stack. It will be understood that changes in dimensions and in the relative spacing and configuration of the shield and stack may necessitate some changes in the apparatus and operating conditions, all of which will be within the scope of the invention and the routine skill in the art.

EXAMPLE

A field test of the method of the invention was undertaken with a flare stack that was producing a significant amount of visible smoke due to insufficient oxygen in the fuel/waste gas mixture. The following data establish the efficacy of the method. In this test the air requirements were only 1.2 times the steam requirements, based on volume flow rates. The smoke intensity data is based on an industry-accepted standard for comparative measurements. The units are:

MMSCFD—millions of standard cubic feet/day; and

SCFM—standard cubic feet/minute.

| Gas Flow MMSCFD | Jets # | HP Air SCFM | Smoke Intensity |
|---|---|---|---|
| 1 | 0 | 0 | 100% |
| 1 | 16 | 35 | 40% |
| 1 | 8 | 50 | 0% |
| 2 | 8 | 55 | 0% |

The results indicate the beneficial effect of increasing the flow rate by reducing the number of nozzles from 16 to 8. No observable reduction in smoke intensity was noted with the increase in flow rates from 70 to 75. It will also be understood that an additional reduction in the flow rate could be undertake to determine the optimum conditions for this particular set of smoke/fuel/waste gas parameters.

The above describes the principal features of the invention. It does not limit its application and, as will be apparent to one of ordinary skill in the art, the details of the construction will vary with the geometry of the flare tip and other parameters relating to operational characteristics of the installation. Those skilled in the art will recognize and be able to ascertain many equivalents to the specific embodiments of the invention that are described herein using no more than routine experimentation. Such equivalents are intended to be encompassed in the scope of the claims that follow.

I claim:

1. An apparatus for enhancing the complete combustion of an undesired chemical and to thereby minimize the formation of smoke in the operation of a flaring stack, the flaring stack having an outlet for the discharge of a flare feedstream that comprises a combustible mixture formed by the undesired chemical and a fuel gas, an igniter located proximate the stack outlet for producing a flame from said combustible mixture, and a shield that is positioned coaxially around the outside surface of the stack proximate the stack outlet, the apparatus comprising:

a. a plurality of high pressure air jet nozzles spaced apart at predetermined positions below and around the exterior periphery of the flare stack outlet in an annular space defined by the shield and stack, each of the air jet nozzles being directed toward the stack outlet and in the direction of the feedstream's movement; and b. a source of high pressure air in fluid communication with the plurality of nozzles, whereby the discharge of the air from the nozzles forms a plurality of high-velocity air jets to produce a moving air mass that draws additional atmospheric air into the mass of air moving toward the stack outlet to thereby enhance combustion of the flare feedstream; and c. a plurality of low pressure wind control nozzles positioned around the periphery of the stack outlet and directed inwardly, wherein a low pressure curtain of air is formed to flow inwardly and upwardly from the stack outlet at the base of the flame to minimize the effect of atmospheric cross winds disruptive to an optimum combustion patterns of the flame.

2. The apparatus of claim 1 which further includes a high pressure air manifold, each of the high pressure nozzles being mounted on the manifold, the manifold being in fluid communication with the high pressure air source.

3. The apparatus of claim 2, wherein the manifold encircles the flare stack in the annular space between the shield and the stack.

4. The apparatus of claim 1, wherein each of the plurality of nozzles is positioned to direct an air jet at an angle that is acute to the longitudinal axis of the stack and tangential to the stack wall.

5. The apparatus of claim 1, wherein the high pressure air source is at a pressure of about 30 to 35 psig.

6. The apparatus of claim 1, wherein the exterior shield is concentric with the flare stack throughout the length of the shield.

7. The apparatus of claim 6, wherein the downstream portion of the shield is provided with a plurality of air inlet passages.

8. The apparatus of claim 6 which further includes a plurality of air directing vanes extending generally parallel to the angle of the high pressure air jets in spaced relation around the periphery of the stack.

9. The apparatus of claim 8, wherein the plurality of vanes includes a pair of vanes extending from the surface of the shield and adjacent each nozzle.

10. The apparatus of claim 1 wherein the plurality of low pressure wind control nozzles positioned around the periphery of the stack outlet are directed inwardly at an angle of about 45 degrees to a diameter extending through the control nozzle.

11. The apparatus of claim 7, wherein the shield extends to a position above the stack outlet.

12. The apparatus of claim 11, wherein the upper portion of the shield tapers inwardly.

13. The apparatus of claim 1, wherein the low pressure nozzles are supplied with air at a pressure of about 5 to 10 psig.

14. The apparatus of claim 1, wherein said coaxial shield includes an upper end that is planar with said stack outlet.

15. The apparatus of claim 1, wherein said coaxial shield includes an upper end that extends above said stack outlet.

16. A method of enhancing the complete combustion of an undesired chemical and minimizing the formation of smoke from an outlet of a flaring stack during operation, the method comprising:

a. providing a flare feedstream formed from a combustible mixture of the undesired chemical and a fuel gas;

b. discharging the flare feedstream from the outlet of a flare stack;

c. igniting the flare feedstream to form a flame in a combustion zone;

d. providing a plurality of high velocity air streams in the form of air jets spaced apart at predetermined positions below and around the exterior periphery of the flare stack outlet, each of the plurality of air jets directed to move upwardly along the wall of the stack toward the combustion zone to thereby create a low-pressure zone below the end of the outlet of the flare stack, wherein the air jets cause an influx of atmospheric air into the low pressure zone and turbulence in the combustion zone to enhance combustion of the flare feedstream; and e. providing a plurality of inwardly directed, low pressure air streams from a plurality of wind control nozzles proximate the periphery of the outlet of the flare stack, wherein a low pressure curtain of air is formed to flow upwardly from the outlet at the base of the flame to minimize the effect of atmospheric cross-winds disruptive to an optimum combustion patterns of the flame.

17. The method of claim 16, wherein each of the plurality of air jets moves from a position below the outlet of the flare stack.

18. The method of claim 16 which includes the further step of providing an exterior concentric shield extending around and spaced apart from the periphery of the portion of the flare stack adjacent the outlet to thereby channel the atmospheric air upwardly with the air jets.

19. The method of claim 18, which includes the further step of providing the concentric shield with a plurality of openings positioned adjacent the downstream end and extending through the shield.

20. The method of claim 18, wherein the concentric barrier extends to a position above the stack outlet.

21. The method of claim 16, which includes the further step of directing said plurality of inwardly directed low pressure air streams at an angle of approximately 45 degrees towards the stack outlet.

* * * * *